US005127309A

United States Patent [19]

Menges et al.

[11] Patent Number: 5,127,309

[45] Date of Patent: Jul. 7, 1992

[54] RAPID STOP DEVICE FOR AN EXATERNALLY DRIVEN AUTOMATIC WEAPON

[75] Inventors: Horst Menges, Ratingen; Lothar Post, Düsseldorf; Bernhard Schneider, Niederkrüchten, all of Fed. Rep. of Germany

[73] Assignee: Rheinmetall GmbH, Düesseldorf, Fed. Rep. of Germany

[21] Appl. No.: 92,734

[22] Filed: Aug. 17, 1987

[30] Foreign Application Priority Data

Aug. 16, 1986 [DE] Fed. Rep. of Germany ..... 3627362

[51] Int. Cl.[5] ..... F41A 7/00

[52] U.S. Cl. ..... 89/11

[58] Field of Search ..... 89/9, 11, 12, 13.05

[56] References Cited

U.S. PATENT DOCUMENTS

| | | | |
|---|---|---|---|
| 3,175,464 | 3/1965 | Rocha | 89/11 |
| 4,131,052 | 12/1978 | Skahill | 89/11 |
| 4,154,143 | 5/1979 | Pechamat et al. | 89/11 |
| 4,193,335 | 3/1980 | Tassie | 89/7 |
| 4,301,709 | 11/1981 | Bohorquez et al. | 89/11 |
| 4,508,006 | 4/1985 | Post et al. | 89/9 |
| 4,550,641 | 11/1985 | Bruderer et al. | 89/11 |
| 4,683,799 | 8/1987 | Post et al. | 89/11 |
| 4,699,040 | 10/1987 | Menges | 89/11 |

FOREIGN PATENT DOCUMENTS 3307882 9/1984 Fed. Rep. of Germany .

*Primary Examiner*—David H. Brown

*Attorney, Agent, or Firm*—Spencer, Frank & Schneider

[57] ABSTRACT

A rapid-stop device for the control roller of an automatic weapon wherein for a space-saving arrangement, a brake unit forming part of the rapid-stop device is disposed in a longitudinally axial bore of the control roller. Within its jacket, the brake unit includes brake shims and pretensioned spring elements 79. The brake unit jacket is mounted on a central mandrel, which is fixed to the cradle housing, so as not to be displaceable in the axial direction, and is connected with the control roller so that it can rotate with same and so that the control roller can move axially relative to the jacket. For a braking process required in the case of malfunction or during normal shut-down of the automatic weapon, a trigger catch lever or a rapid-stop catch lever disposed in the housing engages in the sole catch edge of a brake disc which is coaxial with the support mandrel. At the same time, a control disc, which is drivingly connected for rotation with the control roller and which is normally connected with the brake disc in a forming locking manner by an axial displacement arrangement, displaces the brake disc, under the inertia of further rotating parts connected to the control disk, in the direction of the brake shims, and thus performs a safe and attenuated brake stroke.

10 Claims, 6 Drawing Sheets

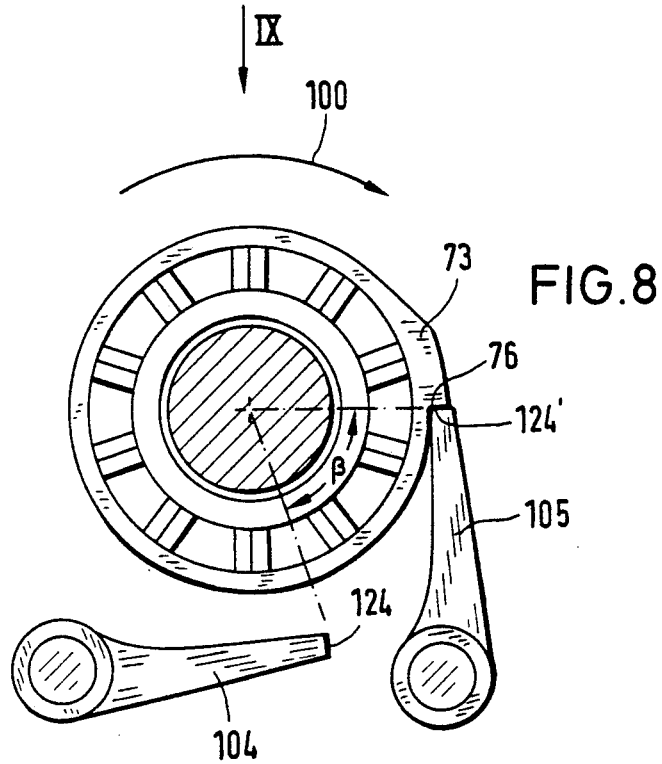
FIG.8
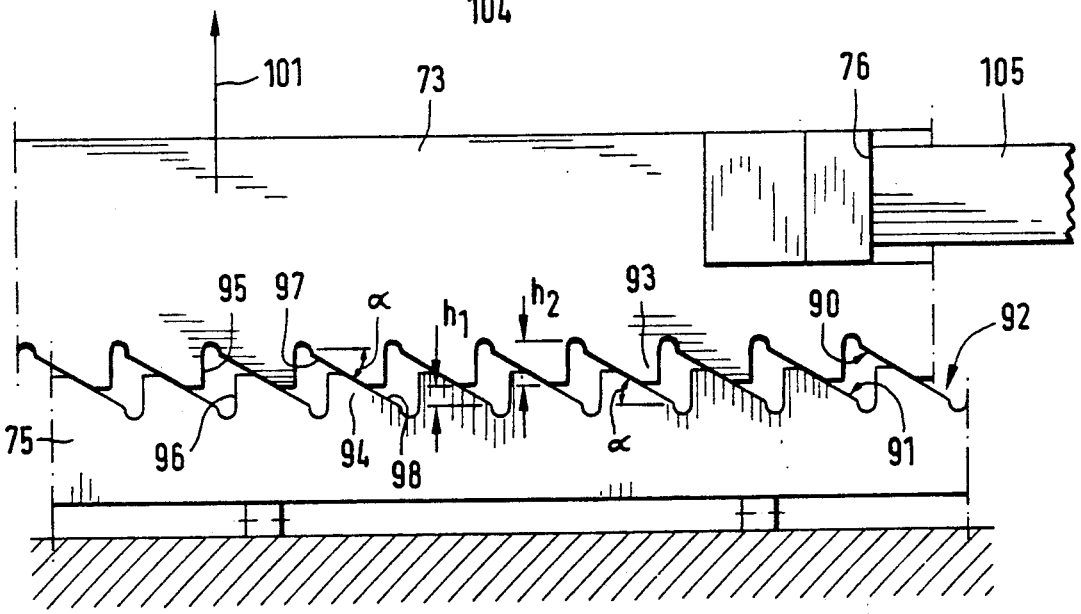
FIG.9
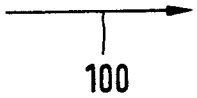

RAPID STOP DEVICE FOR AN EXATERNALLY DRIVEN AUTOMATIC WEAPON

CROSS REFERENCE TO RELATED APPLICATIONS

The present application is related to applicants' following concurrently filed U.S. patent applications, the subject matter of which are incorporated herein by reference:

(1) U.S. patent application Ser. No. 07/092,733, entitled RIGIDLY LOCKABLE STRAIGHT-ACTION BREECH BLOCK FOR AN EXTERNALLY DRIVEN AUTOMATIC WEAPON;

(2) U.S. patent application Ser. No. 07/094,26, entitled ALTERNATABLE DUAL CARTRIDGE SUPPLY SYSTEM FOR AN EXTERNALLY DRIVEN AUTOMATIC WEAPON; and (3) U.S. patent application Ser. No. 07/094,260, entitled RAPID-STOP DEVICE FOR AN EXTERNALLY DRIVEN AUTOMATIC WEAPON .

BACKGROUND OF THE INVENTION

The present invention relates to a rapid-stop device for an externally driven automatic weapon of the type including a straight-action breech block driven by a control roller or drum. More particularly, the present invention relates to such a rapid-stop device which includes an axial displacement means for, at least in the case of a weapon malfunction, activating brake shims to interrupt the rotary movement of the control roller for the straight-action breech block, and which is disposed in the weapon housing.

Such a rapid-stop device is known from Federal Republic of Germany DE-OS 3,307,882, published Sep. 6, 1984. The rapid-stop device disclosed in this reference prevents, in the case of a malfunction, further rotation of two control rollers provided for a straight-action breech block. The device is disposed at the rear end of each control roller and requires a detonator which is flanged to the breech housing to activate brake shims for sudden braking. In the case of a malfunction, a longitudinally displaceable claw shaft is detained, under the gas pressure developed by the detonator, in pockets disposed at the frontal face of the respective control roller, with it being necessary to first shear off a shear pin which holds the claw shaft in the rest position. A helical gear disposed between the claw shaft and the lamella coupling then transfers the braking moment of the lamella coupling to the drive shaft.

It is considered a drawback of this rapid-stop device that after each malfunction, the rapid-stop device must be disassembled so that the shear pin and the detonator can be replaced. Moreover, the firing reliability of the detonator may be adversely affected, for example due to contact with it, particularly if there are further switching units. It is a further drawback that this rapid-stop device requires a large amount of expensive space within the breech housing. Due to this structure and particularly due to this mode of operation, this rapid-stop device is also not suitable for an interruption of the normal firing operation. The braking process required during shutdown to interrupt the firing operation necessitates a separate catching device in which, for example, a catch lever or camming pawl, clamped by a spring, engages in a catch edge or recess as disclosed in U.S. Pat. No. 4,193,335.

SUMMARY OF THE INVENTION

In contrast thereto, it is an object of the present invention to provide a reliable and space-saving rapid-stop device for a single control roller provided for operating the breech block which also ensures actuation and reliable interruption of the normal firing operation.

The above object is achieved according to the present invention by an externally driven automatic weapon of the type including a weapon housing, a straight-action breech block driven by a control roller disposed in the weapon housing, and a rapid-stop means, including brakes shims and an axial displacement means for activating the brake shims, for interrupting the rotary movement of the control roller at least in the case of a weapon malfunction; and wherein a further housing is disposed at the rear of the weapon housing and fixed to a cradle or gun mount, the control roller, in its primary longitudinal extent, is provided with a coaxial cylindrical bore which is open at its end facing the further housing, and the rapid-stop means comprises:

a brake unit disposed within the bore and including an outer tubular jacket in which the brake shims are disposed, means provided on the exterior surface of the jacket for connecting the jacket to the control roller so that the jacket moves along with the control roller in the circumferential direction while permitting axial displacement of the control roller relative to the jacket, and an axially displaceable pretensioned spring means, disposed at least partially within the jacket between the shims and the further housing for pressing the brake shims against one another upon axial displacement of the spring means to brake the jacket and control roller;

means for fastening the jacket to the further housing so as not to be displaceable in the axial direction including a central mandrel mounted in the further housing and extending along the longitudinal axis of the jacket, and means including at least one axial bearing and a radial bearing for mounting the jacket on the mandrel;

an axially displaceable brake disc, having a single catch edge on its peripheral surface, and a control disc disposed within the further housing and coaxially surrounding the central mandrel, with the control disc being drivingly connected with the control roller;

a rapid-stop catch lever, which operates as a function of firing, and a trigger catch lever of a trigger mechanism pivotally mounted in the further housing at respective positions to selectively engage the single catch edge of the brake disc to prevent rotation of same; and the axial displacement means includes gear teeth, having meshing inclined follower surfaces, which are disposed on the respective mutually facing end surfaces of the brake disc and of the control disc and which normally cause the discs to rotate together, and with the meshing surfaces of the gear teeth being configured so as to produce, upon engagement of one of the catch levers in the single catch edge of the brake disc and due to the existing rotation energy of at least the control roller, an axial displacement of the brake disc and the spring means to press the brake shims together with the axial brake stroke produced by the axial displacement being limited, in a form locking manner, by the spring means and the brake shims.

The present invention makes it possible in an advantageous manner to arrange significant, space consuming elements of the rapid-stop device, for example the brake shims and a spring unit, in the control roller in a space saving manner. The brake shims, which are pressed together by a spring unit during braking, are then encased by a jacket which rotates together with the control roller and together with a central mandrel fixed to the cradle housing or to the gun mount housing and form a brake unit which is inserted into a bore in the control roller. The outer jacket of the brake unit and the bore of the control roller are provided with connecting means to enable them to be carried along together in the circumferential direction and to be relatively displaceable in the axial direction, thus enabling the control roller to slide on the brake unit during the recoil and counterrecoil movement generated during the development of a shot and, moreover, eliminating the need for a special recoil and counterrecoil chamber for the brake unit, thus saving space.

In a particularly advantageous manner, the axial displacement of the spring unit for pressing the brake shims together is generated in a form locking manner by a brake disc and a control disc so that defined, reproducible, safe and smooth braking actions can be realized. When the rapid-stop device or a trigger catching lever engages in a single catch edge disposed on the brake disc, meshing oblique or inclined gear-like teeth on the brake disc and on the control disc utilize the rotational energy, particularly of the control roller, for the performance of the axial brake stroke. During the relative longitudinal displacement of the gear teeth, the increasing braking effect also reduces the centrifugal force of the rotating gear masses and of the control roller. The braking force, the brake angle and the pitch of the gear tooth flanks are here in a direct relationship and in equilibrium so that the braking process takes place in a particularly advantageous manner, positively and automatically and without causing excessive wear of the gears.

Due to the fact that the rapid-stop catch lever and the trigger catch lever are able to engage in the sole catch edge of the brake disc, a second space consuming brake disc becomes superfluous and the structural length of the entire braking device is shorter.

According to a further feature of the invention, the brake stroke is fixed by the displacement path of the spring unit which is shorter than the axial height of the oblique or inclined or gear teeth so that, under consideration of the adaptation of the rotation angle and the pitch of the inclined gear teeth to the brake angle, the entire system can advantageously not become asynchronous.

According to a further feature, a compression spring is disposed between the spring cup and the jacket of the brake unit, thus returning the brake disc, once it has been released by the trigger catch lever, to its original position and producing a secure contact without play.

The fastening position of the rapid-stop catch lever and of the trigger catch lever to be engaged in the single catch edge are fixed in such a way that, in the case of malfunction, the rapid-stop catch lever engages and interrupts firing immediately before the trigger catch lever is ready to engage. The spacing in the direction of rotation between both catch levers which are able to engage in the brake disc is here selected so that the stopping process in both cases takes place in the rear rest position of the breech block.

According to a further feature, the rapid-stop device is equipped with a piston which is controlled as a function of the gas pressure generated during development of a shot and which, after a misfire moves the rapid-stop catch lever from the position in which it blocks the catch edge of the brake disc, but which, when there is a delay in the detonation or a failure of the detonator, leaves the catch lever in the position in which it blocks the brake disc so that, in the case of malfunction, the automatic weapon is stopped when its breech is blocked.

Means are further provided for retaining and releasing the rapid-stop catch lever once it has been moved out of the catch edge. These means are reliably actuated in a form locking manner as a function of the firing cycle.

The invention will now be described below in greater detail with reference to an embodiment that is illustrated in the drawings.

BRIEF DESCRIPTION OF THE DRAWINGS

FIG. 8 is a front view of an arrested or blocked brake disc seen in the direction marked VI in FIG. 3.

FIG. 9 is a partial top view of the control disc and brake disc, after it has performed the braking stroke, seen in the direction marked IX in FIG. 8.

DETAILED DESCRIPTION OF THE PREFERRED EMBODIMENT

Figure 1:
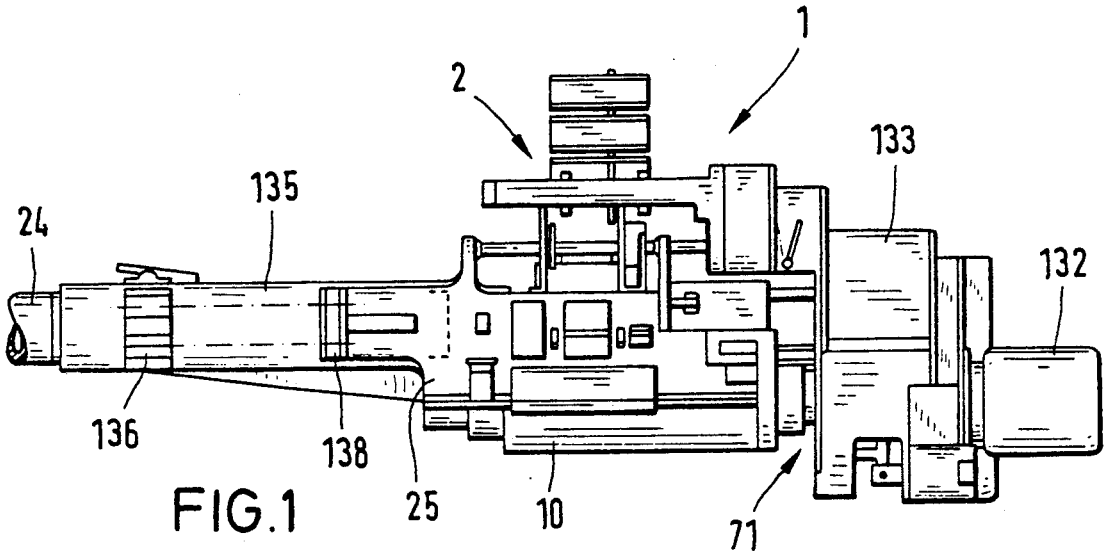
FIG. 1 is a side view of an externally driven automatic weapon according to the invention.
Figure 2:
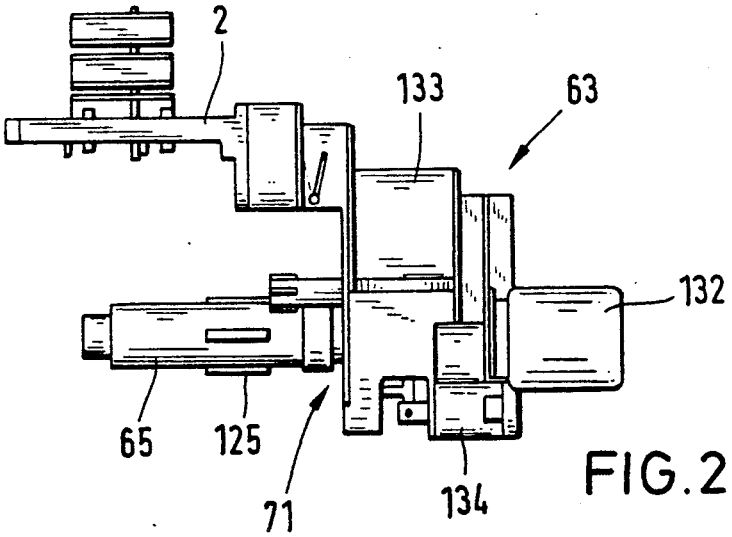
FIG. 2 is a side view of the parts of the device shown in FIG. 1 fixed to the cradle housing and showing the rapid-stop device according to the invention.

FIG. 1 shows the overall structure of an externally driven automatic weapon 1 in which the drive 132 for the weapon, an associated gear assembly 133, a trigger mechanism 134, the partial region of a dual cartridge alternating feeder 2 and the brake unit 65 (see FIG. 2) of a rapid-stop device 71 are disposed in a housing 63 which is shown individually in FIG. 2 and which is fixed to a cradle or gun mount (not shown). In a housing 25, which is connected with the gun barrel 24 and which recoils together therewith when a shot is fired, there are disposed a control roller 10 for the breech block drive, a breech block 9 (FIG. 3), a recoil braking and counterrecoil device 135 as well as a further partial region of the dual cartridge alternating feeder 2.

Housing 25, which is fixed to the weapon, is provided on its exterior with slide guides 136 for positioning it within a weapon carrier which may be articulated in the form of a gun mount (not shown) or a cradle in the turret system (likewise not shown) of a tank. Weapon housing 25 is equipped with two fast action locks, one lock 138 connecting weapon housing 25 with the weapon carrier, while the other lock (not shown) is disposed at the point of intersection between the ammunition intake and weapon housing 25.

Figure 3:
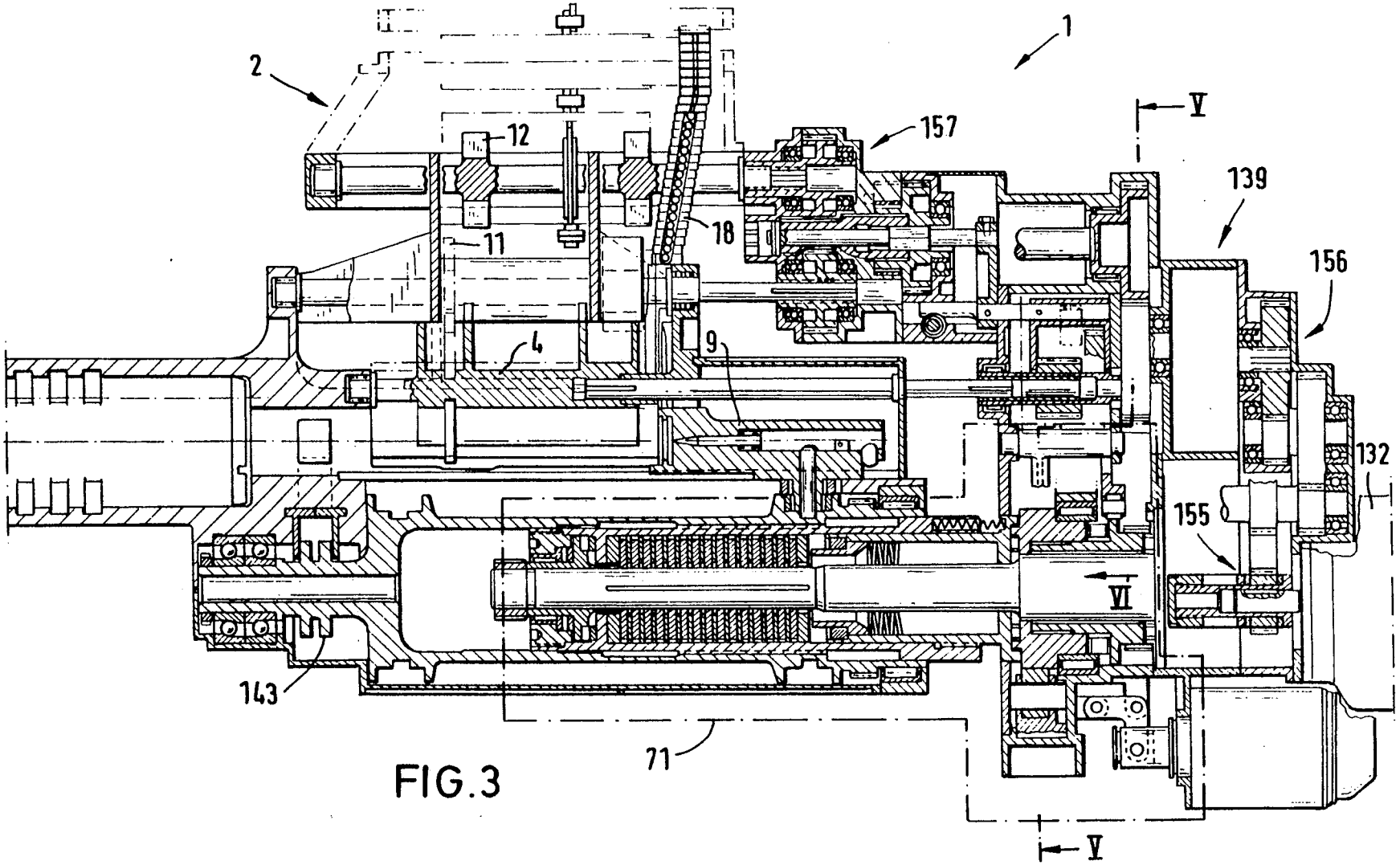
FIG. 3 is a longitudinal sectional view of the automatic weapon of FIG. 1.

FIG. 3 shows the details of the structure of automatic weapon 1. The region of the rapid-stop device 71 which is relevant for the present invention is shown in dot-dash lines and is shown in an enlarged view in FIG. 4. The region of the cartridge feed within the dual cartridge alternating feeder 2, which essentially includes star feed wheels 11, 12, rotor 4, cartridge supply means 18 and gears 157 (transmission), 139 (stepping gear), 156 (distributor gear), and 155 (intermediate gear), is the subject of one of the above identified concurrently filed patent applications and is therefore not described in detail here. Moreover, the locking mechanisms 143 for the straight-action breech block 9 is the subject of another of the above identified concurrently filed patent applications so that, in this connection again, a more precise description does not appear to be necessary.

Figure 4:
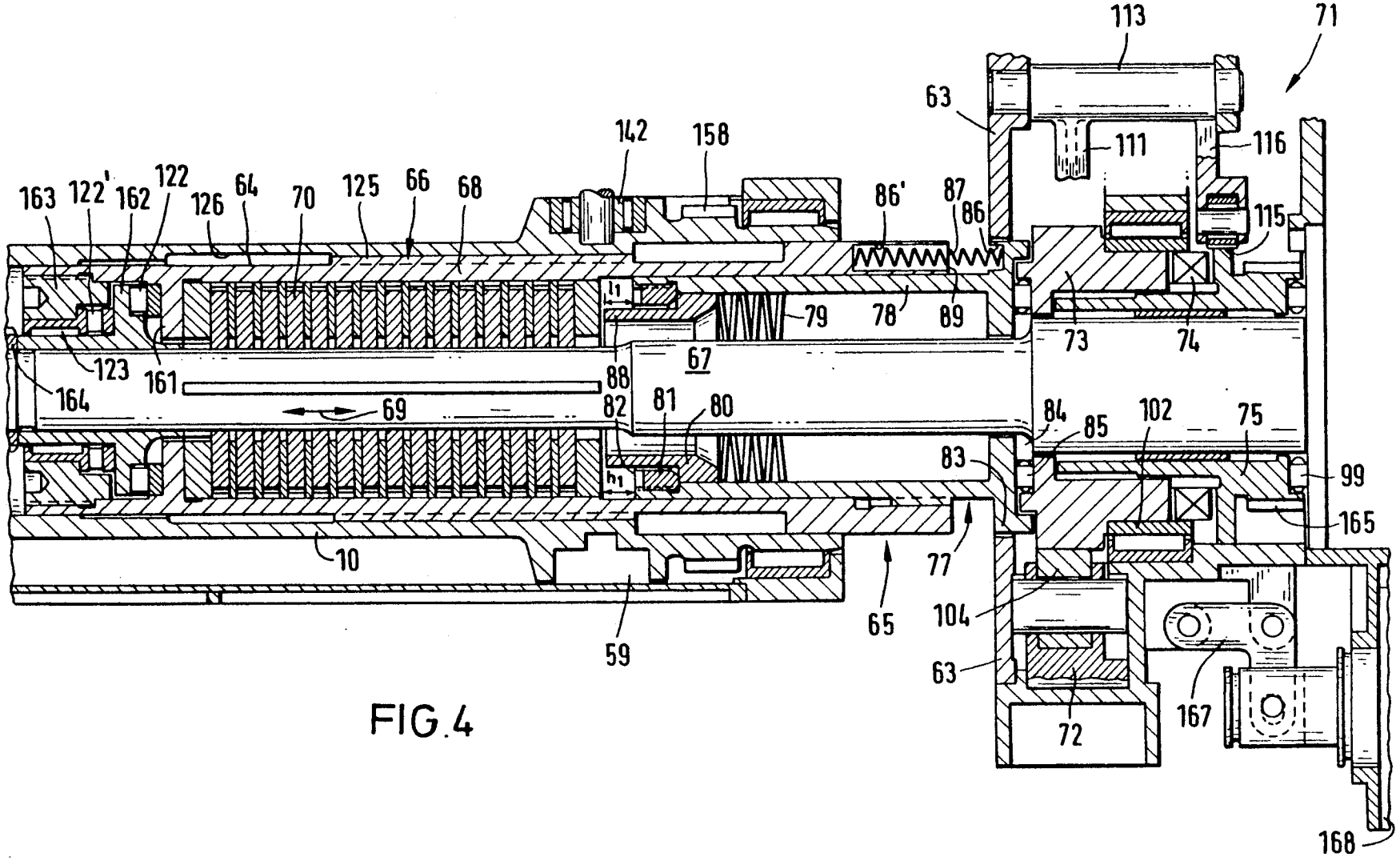
FIG. 4 is an enlarged view of the rapid-stop device as shown in FIG. 3.

As shown in a sectional view in FIG. 4, the control roller or drum 10 has, on its exterior surface, a cylindrical cam 59 in which engage control means 142 to perform the longitudinal movement of the straight-action breech block 9 (FIG. 3). Breech block 9 is locked when in a forward position (not shown). If there is a malfunction of the detonator or a delay in firing, automatic weapon 1, and control roller 10 in particular, are quickly stopped or shut down by a brake unit 65 which is part of the rapid-stop device 71 and is disposed within an axial bore 64 of control roller 10.

Brake unit 65 includes an essentially tubular jacket 68 which is provided with an arrangement 66 for connecting the jacket 68 to the control roller 10 so as to enable jacket 68 to be carried along in the circumferential direction with roller 10 and to be axially displaceable relative to control roller 10. For this purpose, cylindrical bore 64, which is open at the rear toward the housing 63 fixed to the cradle or the gun mount so as to accommodate the brake unit 65, extends forwardly beyond a primarily longitudinal region of control roller 10 wherein the inner surface of the control roller is provided with a plurality of longitudinally extending recesses 126 which engage corresponding portions of a multiple wedge serration 125 (see also FIG. 2) formed on the outer surface of the jacket 68. As a result of this connecting means 66, i.e., the engagement of the multiple wedge serrations 125 on the jacket 68 with recesses 126, the control roller 10 is able to move backward and forward again on the brake unit 65 under the recoil effect of a fired shot.

Within its essentially tubular jacket 68, brake unit 65 includes a pretensioned spring unit 77 as well as brake shims 70 which are pressed against one another by spring unit 77. In its front region, jacket 68 includes a wall 161 in the form of a circular ring provided for axially supporting brake shims 70 and fastening jacket 68 to a central axially extending mandrel 67 which is fixedly mounted in the cradle housing 63. At its front face, wall 161 is supported by an axial bearing 122 opposite a bushing 162 fastened on central mandrel 67. In order to radially and simultaneously axially fix wall 161 with respect to bushing 162, a nut 163 is provided which can be screwed into jacket 68 and which receives in its interior a radial bearing 123 supported on central mandrel 67, while in the axial direction it secures a further axial bearing 122' supported on bushing 162. The axial forces generated during the braking process are thus transferred to axial bearing 122 by the corotating wall 161 of jacket 68 and from axial bearing 122 by way of bushing 162 to a nut 164 screwed onto central mandrel 67.

The axially displaceably disposed brake shims 70 are fastened in the circumferential direction, in a known manner, selectively on thinner surface of jacket 68 or on the central mandrel 67.

Spring unit 77 is composed of a spring cup 78 arranged coaxially around central mandrel 67 and encloses spring elements 79, preferably in the form of cup springs. To pretension spring elements 79, spring cup 78 is provided, at its end 82 facing brake shims 70, with an annular nut 81 having an external thread and a bushing 80 which is disposed between nut 81 and spring elements 79 and which is slidable within spring cup 78. For the further compression of spring elements 79, this bushing 80 is provided with an extension going beyond the frontal end of spring cup 78 whose length $l_1$ beyond the end of spring cup 78 is less than the displacement path of spring cup 78 defining the brake stroke $h_1$, thus ensuring some play.

The end of spring cup 78 facing away from brake shims 70 includes a frontal face 83 which extends radially beyond the outer diameter of spring cup 78 and is provided, on its exterior, with a bore 84 to accommodate an axial bearing 85 supporting a brake disc 73. To produce contact of spring cup 78 with axial bearing 85 without play, a spring guide 86 disposed at frontal face 83 but facing brake shims 70 accommodates a compression spring 87 supported at the opposite frontal face 89 of jacket 68 of brake unit 65. Spring 87 is likewise guided in a guide 86' in jacket 68.

To initiate a braking process, a catch lever 105 (FIG. 5) of rapid-stop device 71 disposed in housing 63 and operating in dependence on firing, or a trigger catch lever 104 of a trigger mechanism 72, is in a tangentially engaged position in the sole catch edge 76 (FIG. 5) of the brake disc 73 which coaxially surrounds central mandrel 87. For the pressing process of brake shims 70, brake disc 73 and a control disc 75, which is drivingly connected with control roller 10, are provided on their mutually facing frontal surfaces 90, 91 (FIG. 9) with an oblique or inclined gear tooth arrangement 92 (FIGS. 7, 9) with the teeth being configured so as to form an axial displacement means 74.

According to FIGS. 6 to 9, each tooth 93 on the surface 90 and each tooth 94 on the surface 91 and forming the gear tooth arrangement 92 has a radially and axially parallel extending delimiting surface 95 or 96 respectively and a follower surface 97 or 98 respectively which is inclined at an angle $\alpha$ in the circumferential direction 100. Additionally, as shown in FIG. 9, the axial height $h_2$ of the surfaces 97 and 98 is greater than the brake stroke $h_1$ defined by spring cup 78.

Figure 7:
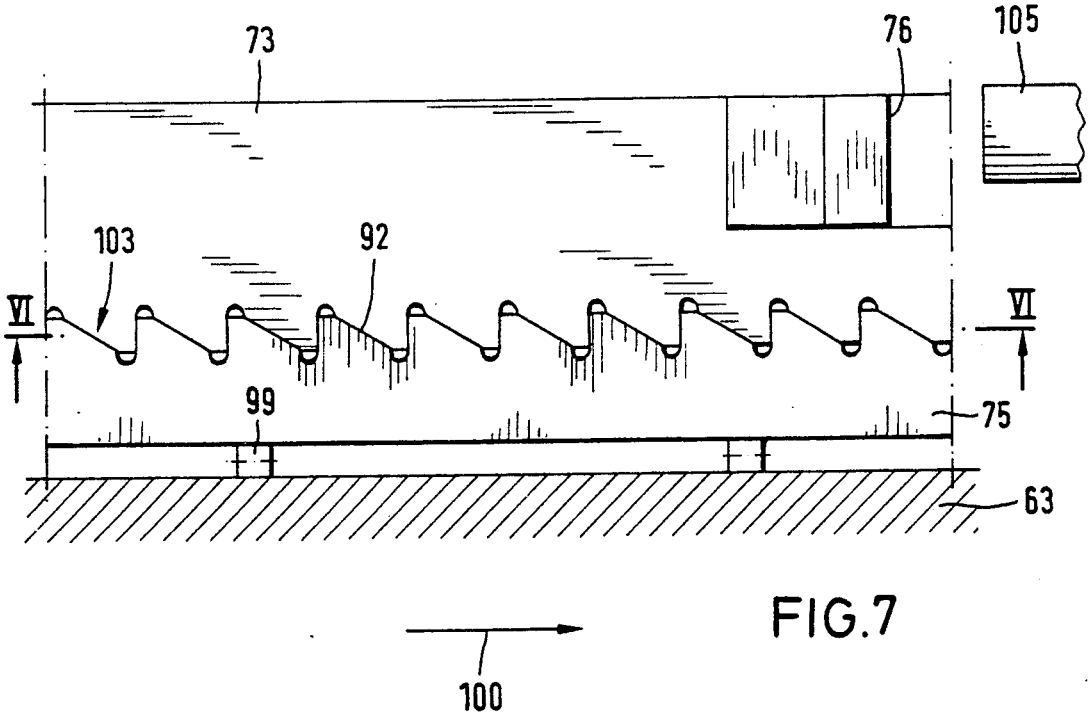
FIG. 7 is a partial top view of the brake disc and the control disc in the neutral or rest position seen in the direction marked VII in FIG. 6.

The angle of inclination $\alpha$ of follower surfaces 97 and 98 has such a dimension that, during firing without malfunctions, brake disc 73 is carried along in a form locking manner under the pressure of compression spring 78 by the rotating control disc 75, with the respective teeth 93 and 94 being engaged in position 103 as indicated in FIG. 7.

As shown in FIG. 4, in order to be able to perform a brake stroke $h_1$, brake disc 73 is disposed so as to be displaceable in the axial direction 101 (FIG. 9) within a radial bearing 102 fastened in housing 63, while control disc 75 is supported, in order to absorb axial pressure forces, against a pressure bearing 99 mounted in housing 63. If brake disc 73 has been stopped by one of catch levers 104, 105 but control disc 75 continues to rotate under the rotation energy of the corotating masses, brake stroke $h_1$ is generated by a sliding movement of the follower surface 98 of control disc 75, which is inclined at an angle $\alpha$ with respect to the equally inclined follower surface 97 of brake disc 73, with the maximum brake stroke $h_1$ being limited in a form locking manner by the compression stroke of spring unit 77. The rotation energy is here generated by the inertia of the corotating gear masses of a gear assembly (not shown) which is required to drive control roller 10 and is connected with distribution gear 156 and particularly by control roller 10 itself. For this purpose, drive gear 158 of control roller 10 and drive gear 165 of control disc 75 are drivingly connected, in a manner not shown, with distribution gear 156 (see FIG. 3).

As shown in FIG. 8, to catch the sole catch edge 76 disposed on the brake disc 73, rapid-stop catch lever 105 is disposed in housing 63 in such a manner that, in the case of malfunction and with the brake disc 73 rotating in the direction of rotation 100, lever 105 is engaged in catch edge 76 within a rotation angle range $\beta$ ahead of trigger lever 104. Rotation angle range $\beta$ of brake disc 73, which rotates in direction of rotation 100, includes an angle $\beta$ less than 90° between blocking or end surfaces 124 and 124' of the trigger lever 104 and rapid-stop-catch lever 105, respectively which tangentially engage in catch edge 76. Thus it is ensured that the braking process occurs during the period when the breech block 9 is locked in the forward position.

Figure 5:
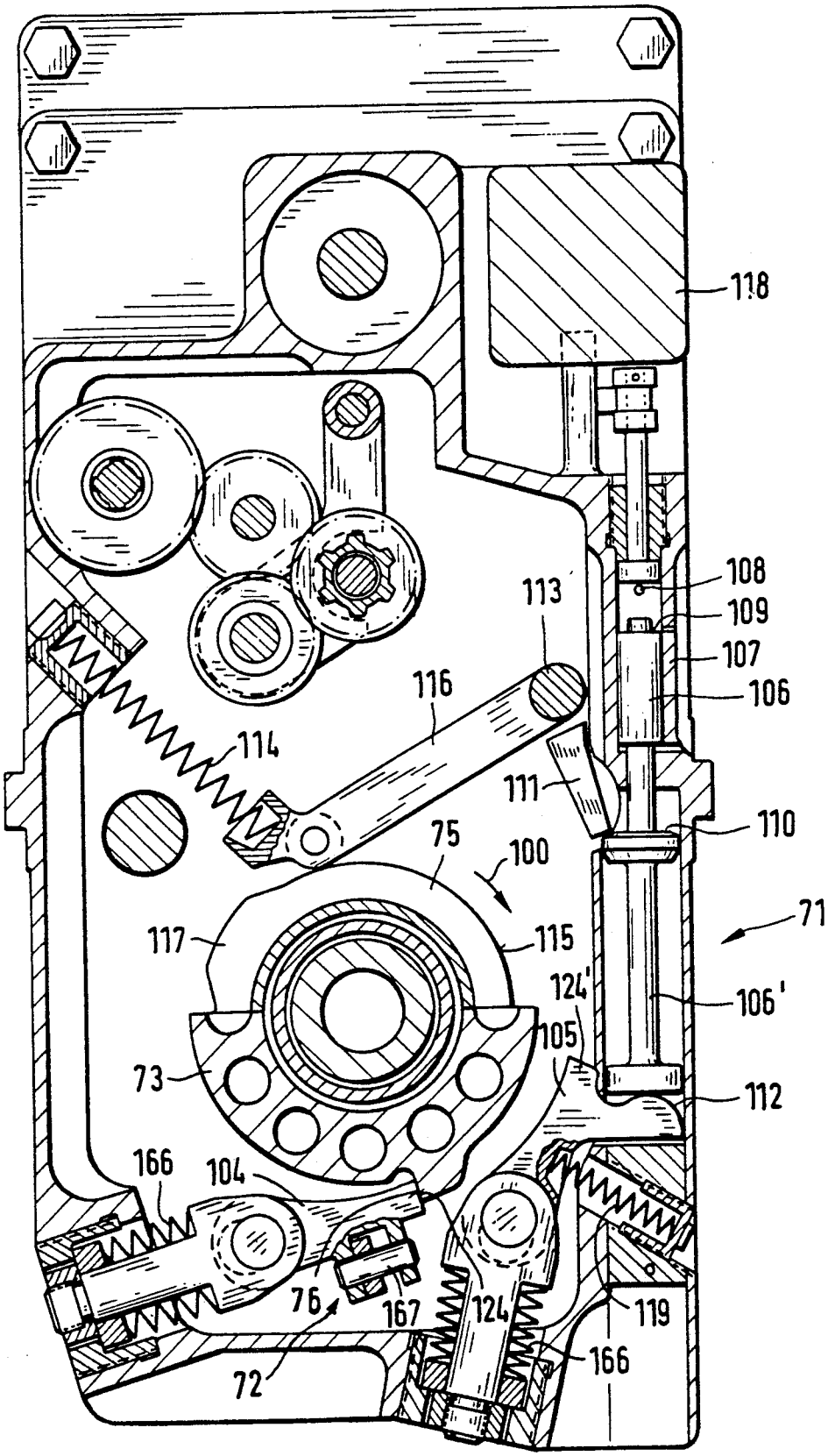
FIG. 5 is a cross-sectional view of the rapid-stop device seen along the line marked V—V in FIG. 3.
Figure 6:
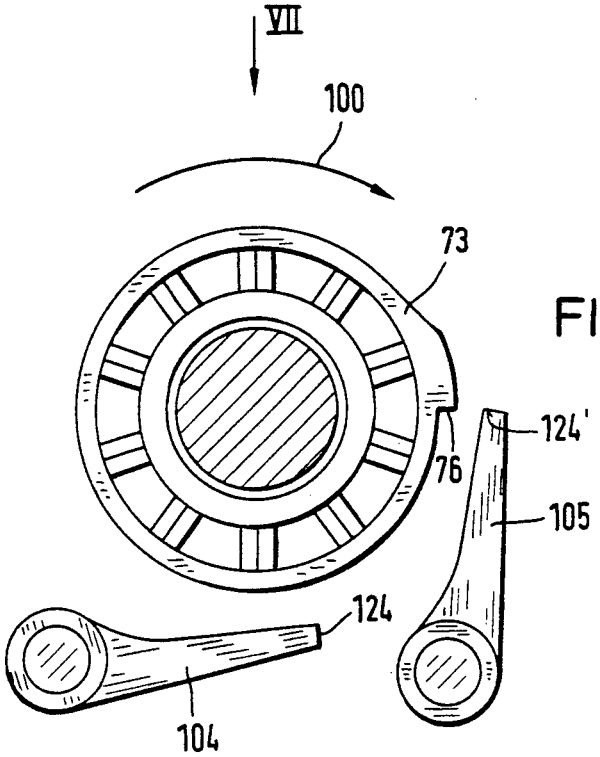
FIG. 6 is a front view of a non-arrested or non-blocked brake disc seen in the direction marked VI in FIG. 3.

As shown in FIG. 5, both the trigger lever 104 and the rapid-stop catch lever 105 are equipped in a known manner with a respective compression spring 166, 166' preferably formed of cup springs, to dampen the brake push. To pivot trigger lever 104 into and out of catch edge 76, a trigger magnet 168 (FIG. 4) is provided which is connected with a lifting mechanism 167.

Rapid-stop device 71 further includes a controllable piston 106 which is controlled as a function of the gas pressure generated during the development of a shot and which is disposed within a cylinder 107. The frontal or end surface 109 of piston 106 is chargeable via a supply line 108 by the gas pressure developed by a misfire. Piston 106 is provided with a piston rod 106' which extends out of the cylinder 107 and which is provided in its center longitudinal region with an annular surface 110, behind which a pivotal safety lever 111 engages if the piston 106 is longitudinally displaced under the gas pressure and holds piston 106 in the displaced position.

The end of piston rod 106' facing away from end surface 109 includes a follower surface 112 which, after a misfire, serves to move blocking face 124' of rapid-stop catch lever 105 out of the position in which it blocks catch edge 76 of brake disc 73.

Safety lever 111 is mounted so as to be pivotal about an axis 113 disposed in housing 63 and is connected in a form locking manner with a control lever 116 which, under the pressure of a spring 114, lies against a cam surface 115 on the periphery of control disc 75. Cam surface 115 includes a raised cam portion 117 which is disposed ahead of catch edge 76 of brake disc 73 in circumferential direction of movement 100 so as to release annular surface 110 which is blocked by safety lever 111 and thus rapid-stop catch lever 105 which has been deflected by follower surface 112 of piston rod 106'.

For loading the weapon, a separate switching magnet 118 is provided in order to move piston 106 and thereby move rapid-stop catch lever 105 out of engagement with the catch edge 76. To enable the rapid-stop catch lever 105 to take up the caught position, i.e., engage the edge 76, it is automatically pivoted against brake disc 73, once piston 106 has been released, by a compression spring 119 supported in housing 63.

It will be understood that the above description of the present invention is susceptible to various modifications, changes and adaptations, and the same are intended to be comprehended within the meaning and range of equivalents of the appended claims.

What is claimed is:

1. In an externally driven automatic weapon including a weapon housing, a straight-action breech block driven by a control roller disposed in said weapon housing, and a rapid-stop means, including brakes shims and an axial displacement means for activating said brake shims, for interrupting the rotary movement of said control roller at least in the case of a weapon malfunction; the improvement wherein a further housing is disposed at the rear of said weapon housing and fixed to a cradle or gun mount, said control roller, in its primary longitudinal extent, is provided with a coaxial cylindrical bore which is open at its end facing said further housing, and said rapid-stop means comprises:

a brake unit disposed within said bore and including an outer tubular jacket, said brake shims which are disposed within said jacket, means provided on the exterior surface of said jacket for connecting said jacket to said control roller so that said jacket moves along with said control roller in the circumferential direction while permitting axial displacement of said control roller relative to said jacket, and an axially displaceable pretensioned spring means, disposed at least partially within said jacket between said shims and said further housing, for pressing said brake shims against one another upon axial displacement of said spring means to brake said jacket and said control roller;

means for fastening said jacket to said further housing so as not to be displaceable in the axial direction including a central mandrel mounted in said further housing and extending along the longitudinal axis of said jacket and means, including at least one axial bearing and a radial bearing for mounting said jacket on said central mandrel;

an axially displaceable brake disc, having a single catch edge on its peripheral surface, and a control disc disposed within said further housing and coaxially surrounding said central mandrel, with said control disc being drivingly connected with said control roller;

a rapid-stop catch lever, which operates as a function of firing, and a trigger catch lever of a trigger mechanism pivotally mounted in said further housing at respective positions to selectively engage said single catch edge of said brake disc to prevent rotation of same; and said axial displacement means includes gear teeth, having meshing inclined follower surfaces, which are disposed on the respective mutually facing end surfaces of said brake disc and of said control disc and which normally cause said discs to rotate together, said meshing surfaces of said gear teeth being configured so as to produce, upon engagement of one of said catch levers in said single catch edge of said brake disc and due to the existing rotation energy of at least said control roller, an axial displacement of said brake disc and said spring means to press said brake shims together with the axial brake stroke produced by said axial displacement being limited, in a form locking manner, by said spring means and said brake shims.

2. An automatic weapon as defined in claim 1, wherein, in order to perform said brake stroke ($h_1$), said brake disc is mounted within a radial bearing which is disposed within said further housing so that it is displaceable in the axial direction and said control disc is axially supported by a pressure bearing mounted in said further housing, with the brake stroke ($h_1$), if said brake disc is stopped but said control disc continues to rotate under the rotation energy of the corotating masses, being produced by a sliding movement of said follower surfaces on said control disc, which surfaces are inclined at an angle $\alpha$, with respect to said follower surfaces on said brake disc which are inclined at the same angle.

3. An automatic weapon as defined in claim 1, wherein said connecting means for said control roller and said jacket of said brake unit include a multiple wedge serration disposed on the surface of said jacket.

4. An automatic weapon as defined in claim 1, wherein said rapid-stop catch lever and said trigger catch lever are disposed within said further housing at positions to engage said single catch edge of said brake disc such that, in the case of a malfunction and with said brake disc rotating in a given rotation direction, said rapid-stop catch lever is engaged in said catch edge with a rotation angle range $\beta$ ahead of the position of said trigger catch lever.

5. An automatic weapon as defined in claim 4, wherein said rotation angle range $\beta$ of said brake disc rotating in said given direction between the positions of the surfaces of said rapid-stop catch lever and said trigger catch lever which are engageable in said catch edge cover an angle $\beta$ which is less than 90°.

6. An automatic weapon as defined in claim 1, wherein said rapid-stop means further includes:

a piston, which is controllable as a function of the gas pressure generated during the development of a shot, disposed within a cylinder, with one end surface of said piston being charged via an intake conduit in said cylinder by the gas pressure generated during a misfire;

a piston rod extending from the other end surface of said piston and being provided in its center longitudinal region with an annular surface behind which a pivotally mounted safety lever engages if said piston is longitudinally displaced by said gas pressure to keep said piston in said displaced position; and a follower surface disposed on the end of said piston rod facing away from said one end surface of said piston and positioned to engage said rapid-stop catch lever, after a misfire and displacement of said piston, and to pivot said rapid-stop catch lever out of the position in which it engages said catch edge and blocks rotation of said brake disc.

7. An automatic weapon as defined in claim 6, wherein:

said safety lever is pivotally mounted about an axis disposed within said further housing and is connected in a form locking manner with a control lever which rests against a peripheral cam surface of said control disc under the pressure of a spring; and said cam surface of said control disc is provided with a raised cam portion which leads said catch edge of said brake disc in the circumferential direction so as to cause said control lever to pivot said safety lever to release said annular surface blocked by said safety lever and thus release said rapid-stop catch lever which has been deflected by said follower surface.

8. An automatic weapon as defined in claim 1, wherein said spring unit means includes a spring cup which surrounds spring elements arranged coaxially around said central mandrel and which, in order to pretension said spring elements, is provided, on its end facing said brake shims, with an annular nut having an external thread and with a bushing which is disposed between said nut and said spring elements and which is able to slide within said spring cup; and wherein, for further compression of said spring elements, a portion of said bushing extends beyond the end surface of said spring cup facing said brake shims, with the length of said portion being less than the axial displacement path of said spring cup during a brake stroke so as to limit the brake stroke ($h_1$).

9. An automatic weapon as defined in claim 8, wherein:

the end of said spring cup facing away from said brake shims includes an end wall which extends laterally beyond the outer diameter of said spring cup; said wall is provided, on its exterior surface, with a bore in which an axial bearing for supporting said brake disc is disposed; and contact of said spring cup with said axial bearing, without play, is produced by a compression spring having one end supported in a spring guide disposed at the surface of said end wall facing said brake shims and having its other end supported at the facing end surface of said jacket.

10. An automatic weapon as defined in claim 9 wherein:

each tooth of said meshing gear teeth includes a radially and axially parallel extending delimiting surface and a follower surface which is inclined at an angle $\alpha$ in the circumferential direction, with the axial height ($h_2$) of said follower surface being greater than the brake stroke ($h_1$) delimited by said spring cup; and said angle of inclination $\alpha$ of said follower surface is dimensioned such that during firing of the weapon without malfunction, said brake disc charged by said compression spring is carried along in a form locking manner by the rotating said control disc with said teeth in total engagement.

* * * * *